United States Patent [19]

Tsui

[11] 4,261,136

[45] Apr. 14, 1981

[54] PULL-TYPE TOY

[75] Inventor: Kwok W. Tsui, Wanchai, Hong Kong

[73] Assignee: Arco Industries Ltd., Kowloon, Hong Kong

[21] Appl. No.: 143,853

[22] Filed: Apr. 25, 1980

[51] Int. Cl.[3] ..... A63H 5/00

[52] U.S. Cl. ..... 46/99; 46/205; 46/112

[58] Field of Search ..... 46/204, 99, 107, 205, 46/114, 98, 106, 101, 97, 112, 191, 192

[56] References Cited

U.S. PATENT DOCUMENTS

| | | | |
|---|---|---|---|
| 230,575 | 7/1880 | Robinson | 46/205 |
| 361,735 | 4/1887 | Waterstraw | 46/204 |
| 889,729 | 10/1907 | Slater | 46/204 |
| 1,823,064 | 9/1931 | Prunetti | 46/204 |
| 2,419,872 | 4/1947 | Beder | 46/107 |
| 2,810,986 | 10/1957 | Doe et al. | 46/99 |
| 2,883,793 | 4/1959 | Crawford | 46/99 |
| 3,423,873 | 1/1969 | Genin | 46/114 |
| 3,437,338 | 4/1969 | Glass et al. | 46/175 X |

*Primary Examiner*—Gene Mancene
*Assistant Examiner*—Mickey Yu
*Attorney, Agent, or Firm*—C. Hercus Just

[57] ABSTRACT

A pull-type toy comprising a hollow body simulating an apple supported rotatably about a vertical pedestal on a base supported by pairs of small wheels and the body having a circular bottom rim engaged by a drive gear on the axle of a pair of the wheels, a bell on the interior of the body periodically rung by a clapper as the body is rotated, and flexible elongated members extending through the body and flexibly moved in bobbing manner by cam means fixedly supported relative to the base on the interior of the body as the latter is rotated while the base is pulled along a supporting surface.

10 Claims, 5 Drawing Figures

PULL-TYPE TOY

BACKGROUND OF THE INVENTION

The present invention pertains to a pull-type toy having a rotating body thereon which simulates an apple and various other features are included therewith, including a bell on the interior thereof.

Pull-type toys having rotatable figures or various other types of elements thereon are not new. Typical previous examples of this type of toy are found in the following prior U.S. Patent Nos.:

361,735 Waterstraw: Apr. 26, 1887;
889,729 Slater: June 2, 1908;
2,419,872 Beder: Apr. 29, 1947;
2,810,986 Doe et al; Oct. 29, 1957.

It also is not new to provide toys, whether pull-type or otherwise, with bells which ring, either while the toy is pulled along a surface or otherwise. Typical examples of this type of toy are found in prior U.S. Pat. Nos. 1,823,064 to Prunetti, dated Sept. 15, 1931, and 3,437,338 to Glass et al, dated Apr. 8, 1969.

Particularly in regard to developing toys for very young children, especially those just beginning to walk, it is found to be highly desirable that such toys should be of a type which have moving objects thereon and to make them even more desirable, various types of bells, musical devices or similar items, are included therewith to attract the child's attention. The present invention is a toy of that type and includes novel features not found in the prior art, details of which are described below.

SUMMARY OF THE INVENTION

It is among the principal objects of the present invention to provide a pull-type toy comprising a horizontal base supported by pairs of wheels of a low profile, the base supporting a substantially spherical object preferably in the form of an apple which is rotatable about the vertical pedestal supported centrally of said base, and the body comprising said simulated apple preferably is hollow and molded from rigid plastic material, and a plurality of flexible elongated members extend from the sides of the body in circumferentially spaced locations and have heads thereon simulating humorous-type heads of worms which bob up and down as the body is rotated when the toy is pulled along a supporting surface.

It is another object of the invention to provide a bell on the interior of the rotating hollow body which is stationarily supported relative to said vertical pedestal that is fixed to the base and a clapper also is supported at one end stationarily on the interior of the rotating body adjacent the bell, said rotating body also including means engageable with said clapper to periodically effect striking of the bell thereby as the body revolves about its vertical axis, incident to the toy being pulled along a supporting surface.

A still further object of the invention is to provide a horizontal, and preferably circular, supporting member on the upper end of the vertical pedestal in fixed relation thereto, said supporting member having means thereon respectively to support said bell and the fixed end of the clapper therefor, said horizontal supporting member including a preferably sinuous type peripheral cam depending from said member and engageable with the inner ends of said flexible elongated members resembling the aforementioned worms to effect movement of the inner ends of said flexible elongated members substantially within a vertical plane, whereby the outer ends therof with the heads thereon move in a bobbing manner and thereby attract the attention of a child in a humorous way.

Still another object of the invention is to form at least the major elements and components of the toy by molding the same from rigid plastic material in a manner to minimize expense of production and assembly, the hollow body comprising the simulated apple preferably being bipartite and including upper and lower parts, said parts being joined substantially along a horizontal plane and said parts respectively including cooperating members which comprise sockets for pivot means intermediately of the ends of the flexible elongated members which simulate worms, the cooperating means being located adjacent the junction of the two parts of the hollow spherical body.

Still another object of the invention is to provide on the interior of the hollow body and fixed thereto, actuating means for the clapper which impinges upon the bell.

Details of the foregoing objects and of the invention, as well as other objects thereof, are set forth in the following specification and illustrated in the accompanying drawings comprising a part thereof.

DETAILED DESCRIPTION OF THE PREFERRED EMBODIMENTS

Figure 1:
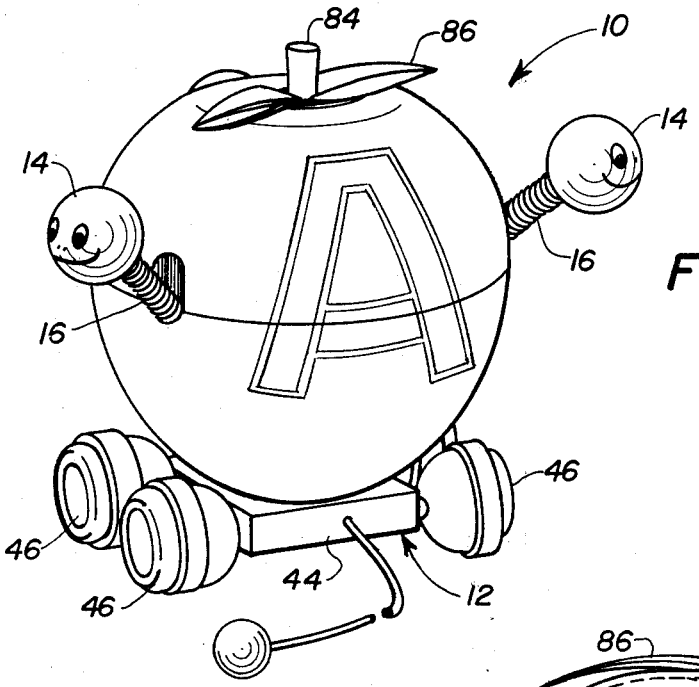
FIG. 1 is a perspective view of the pull-type toy comprising the present invention.
Figure 2:
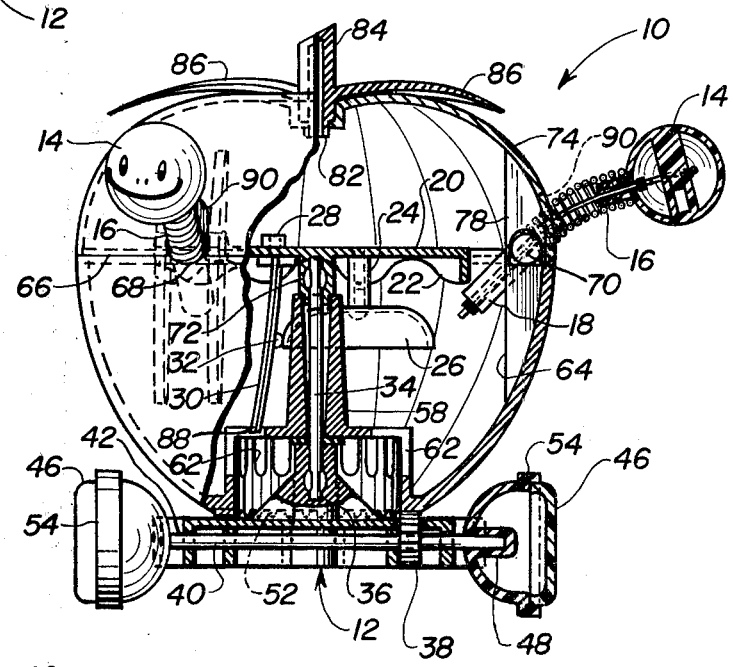
FIG. 2 is a partially vertically sectioned view of the toy shown in FIG. 1, but illustrated on a larger scale than in said figure.

The toy comprising the present invention primarily is of interest to relatively young children who are just beginning to walk and the purpose of the invention is to provide a pull-type toy upon which a body 10 which, as shown in FIGS. 1 and 2, represents a well-known object to young children, namely, an apple and even has the letter "A" thereon to begin to teach the child the alphabet. As the toy is pulled along upon the wheeled base 12, the body 10 rotates about a vertical axis and in addition, humorous appearing heads 14, representing imaginary worm heads, are supported on flexible stems or necks 16 and are moved up and down during the rotation of the body 10 by means of the inner ends 18 of the stems 16 engaging the cam member 20, which is circular in plan view and has a downwardly extending skirt comprising a sinuous cam surface 22. The cam member 20 also has a downwardly extending post 24 upon which a bell 26 is fixedly mounted and the cam member 20 also has another mounting means 28 to which the upper end of a flat flexible spring 30 is attached which has a striker element 32 thereon, which engages the bell.

Figure 5:
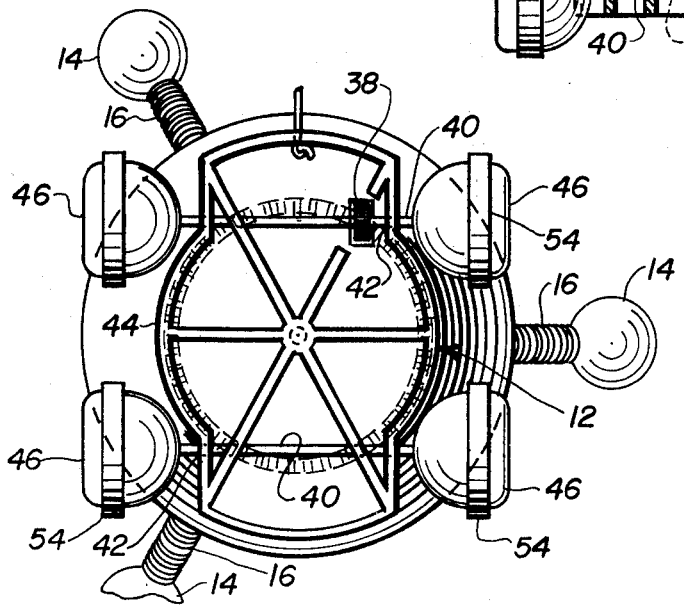
FIG. 5 is a bottom plan view of the base shown in FIG. 2.

As shown in FIG. 5, the base 12 is more or less rectangular and substantially flat and horizontal in use. Preferably, as far as practical, the various components of the toy of the present invention are molded from relatively rigid plastic material and the exceptions comprise the spring stems or necks 16, a metal vertical shaft 34, the lower end of which is fixedly secured in a socket 36, moldably formed upon the base 12, the axles 40 which are formed of steel wire, and the small spur gear 38 mounted on one of the axles intermediately of the ends thereof, as shown in FIGS. 2 and 5. The opposite end portions of the axles 40 project through appropriate bearing holes 42, formed in downwardly extending flanges 44 on the base 12, which extend around the perimeter thereof, as clearly shown in FIG. 5.

Preferably hollow, molded wheels 46 of small diameter and having sockets 48 therein, as shown in the lower left-hand corner of FIG. 2, said sockets firmly and fixedly receiving the opposite ends of the wire axles 40.

The body 10 is bipartite and comprises a lower substantially hemispherical, hollow bottom part 50, which in the bottom end thereof, has a circular opening surrounded by an annular arrangement of gear teeth 52, preferably molded into the bottom rim of the part 50 which surrounds the central opening for engagement with the spur gear 38 by which the body 10 is rotated as the toy is pulled along a floor and to insure rotation of the gear 38 by means of the wheels 46, the wheels preferably are surrounded by a frictional band 54, or this may be substituted for an annular row of serrations molded directly into the wheels and adapted to create a frictional engagement of the wheels with a supporting surface, such as a floor.

Figure 3:
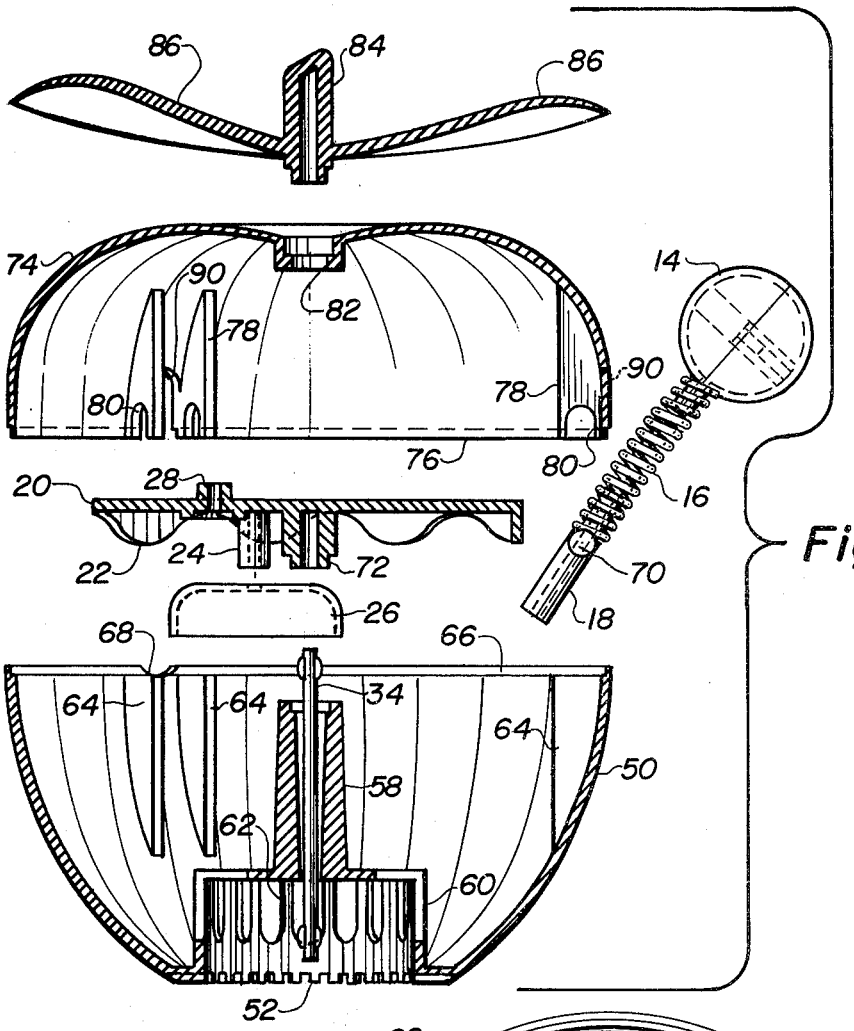
FIG. 3 is a vertically exploded view of the apple-shaped body portion of the toy shown in FIGS. 1 and 2 and illustrating only a single one of the laterally extending elements.

Extending upward from the central opening of the bottom part 50 is a hollow pedestal 58 which is integrally molded to the part 50 by means of an inverted cup-shaped member 60 from which the pedestal 58 extends upward, the member 60 also having a plurality of slots 62 formed therein which extend downwardly, as viewed in FIGS. 2 and 3, for purposes to be described. The hollow pedestal 58, which actually is a rotatable bearing, revolves about the vertical shaft 34 as a result of the engagement of the gear teeth 52 with spur gear 38, when the wheels 46 rotate.

Circumferentially spaced around the upper portion of the bottom part 50 of the body 10 are pairs of ribs 64, the upper ends of which, as viewed in FIG. 3, being slightly below the top rim 66 of part 50, and adjacent each pair of the ribs 64, is a slight concavity 68 extending downwardly in the rim for purposes of receiving a transverse pivot member 70, best shown in FIGS. 2 and 3 on the inner end portions 18 of the stems or necks 16, which support the heads 14. As shown in FIG. 2, said inner ends 18 of the stems or necks 16 engage the sinuous cam surface 22 of cam member 20 when the body 10 revolves about the vertical axis 34, it being understood that the cam member 20 is stationary due to it being fixedly connected to the upper end of the shaft 34 in view of said cam member 20 having a central socket 72, which is best shown in the exploded view of FIG. 3. Preferably, the lower end of the socket member 72 extends a very limited distance into the upper end of the rotatable hollow pedestal 58, as can be seen from FIG. 2. Such engagement of the inner ends 18 of the stems or necks 16 with the sinuous cam surface 22 causes the flexible necks 16 and the heads 14 thereon to bob up and down as the body 10 is rotated when the base 12 is pulled along a floor or the like.

The body 10 also includes an upper part 74 which is hollow and formed of the same plastic material, such as the bottom part 50, the rim 76 thereof having a short circumferential flange which fits into the rim 16 of bottom part 50 for purposes of centering the two parts with each other, as well as affording means by which the coengaging rims may be cemented together during final assembly after disposing the stems or necks 16 in operative position with respect to the pairs of ribs 64. Coengaging the ribs 64 are similar inwardly and downwardly extending pairs of ribs 78 formed on the inner surfaces of the upper part 74 and having semi-circular notches 80 therein within which the transverse pivot members 70 are located when the ribs 78 are brought into abutting engagement respectively with the ribs 64, thereby completing bearing means for the transverse pivot member 70 on the stems or necks 16.

Centrally of upper part 74 is a stepped hole 82 within which the lower end of a simulated apple stem 84 is connected by cementing and a pair of simulated leaves 86 project in opposite directions therefrom.

Figure 4:
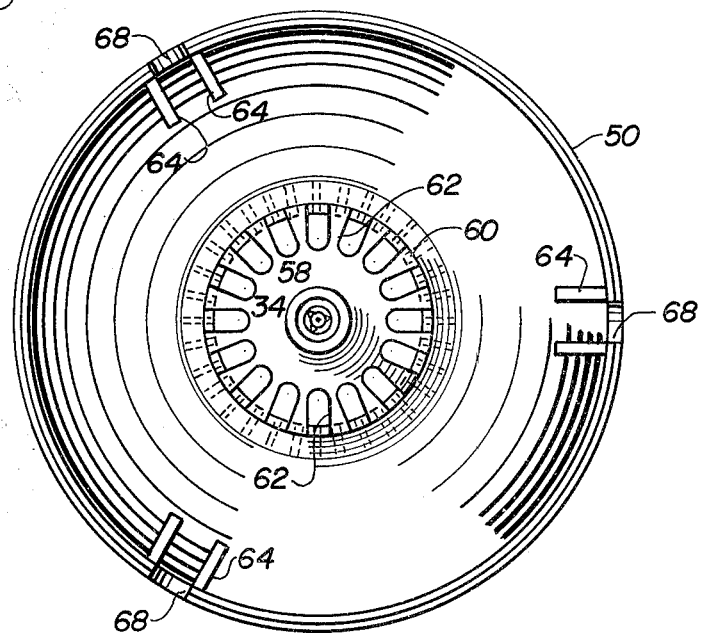
FIG. 4 is a top plan view of the lowermost element shown in exploded manner in FIG. 3.

Before mounting the cam member 20 upon the upper end of shaft 34 during the assembly of the components of the toy, the upper end of the flat flexible spring 30 is connected to the mounting means 28 so that the striker element 32 is in alignment with the bell 26 after the bell has been connected to the lower end of post 24, which depends from cam member 20. After the cam member 20 has been connected to the upper end of shaft 34, following the foregoing assembly of the bell and striking means, rotation of the assembled bottom part 50 and upper part 74 to form the body 10, causes the lower end 88 of the spring 30 sequentially to be engaged by the sidewalls of the slots 62 momentarily and thereby cause the striker element 32 to be moved away from bell 26 but as soon as released from the slot 62, the spring 30 snaps back toward the bell and causes the striker element 32 to engage it and sound the bell sequentially due to the relatively close arrangement of the slot 62 in the member 60, as best shown in FIG. 4.

From the foregoing, it will be seen that the present invention provides an amusing toy comprising a rotatably body with moving heads 14 that wabble up and down, while at the same time producing a ringing of the bell 26, all of which contributes to fun and enjoyment of a young child in particular. The rim of the upper part 74 is provided with notches 90 through which the flexible stems or necks 16 extend, said notches cooperating with the relatively shallow concavity 68 in the upper rim 66 of bottom part 50 to provide ample pivotal movement of the necks 16 and inner ends 18 thereof. The weight of the heads 14 also is adequate to normally cause the same to tend to move the neck 16 clockwise, as viewed in FIG. 2, and thereby hold the inner ends 18 of the stems 16 in engagement with the sinuous cam surface 22 of cam member 20.

Notwithstanding the fact that there is some clearance between the hollow interior at least of the upper portion of the hollow pedestal 58 with the vertical shaft 34, the rotation of the body 10 about the shaft 34 is rendered quite steady, due to the fact that the lower end of the socket member 72 extends at least a short distance into the bore of the upper end of hollow pedestal 58 for relative rotatable movement between the two, but the socket 72 being stationary with respect to base 12. This fact, coupled with the engagement of the circular row of gear teeth 52 with the pinion gear 38 accurately positions the body 10 with respect to the vertical shaft 34 and prevents separation of the body 10 from the base 12.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A pull type toy comprising a substantially horizontal base, a pair of parallel axles rotatably supported by said base in spaced relation to each other in opposite directions from the center of said base, similar wheels on opposite ends of said axles beyond the confines of said base, a fixed pedestal extending centrally upward from said base, a hollow body circular in crosssection and having a vertical bearing sleeve fixed to the lower portion of said body and surrounding said pedestal, a horizontal circular rim on the bottom of said body, a friction drive wheel on one of said axles frictionally engaging said circular rim to rotate said body about said pedestal when said base is pulled along a supporting surface, a bell supported within said body stationarily, a clapper supported within said body adjacent said bell, and means within said body fixed thereto and sequentially engageable with said clapper to impinge the same against said bell as said body is rotated while said base is pulled along said surface.

2. The toy according to claim 1 further including at least one elongated member extending through an opening in the upper portion of said body and pivotally supported by the wall thereof intermediately of the length of said member, and a cam fixed relative to said pedestal and engageable with the inner end of said member, whereby when said body is rotated said cam causes said member to be moved relative to the pivot thereof while said body is rotated while pulled along said supporting surface.

3. The toy according to claim 2 in which a plurality of said elongated members are spaced circumferentially around said hollow body and said elongated members being flexible, and headlike members mounted on the outer ends of said members which have a bobbing movement caused by said cam when said body is rotated as aforesaid.

4. The toy according to claim 3 in which said body simulates an apple and said elongated members with the heads on the outer ends simulate the necks and heads of worms projecting from said body of said apple, and said cam being horizontally circumferential and sinuous in configuration to effect said bobbing action of said heads as aforesaid.

5. The toy according to claim 2 in which said body is molded from relatively rigid plastic material and is at least bipartite and composed of an upper and lower section connected together, said sections adjacent the junction thereof having cooperating members operative to provide pivotable support for said elongated members intermediatedly of the ends thereof.

6. The toy according to claim 1 in which said circular rim on said body is toothed and said friction drive wheel comprising a spur gear engageable with said teeth on said rim to effect positive rotation of said body about said pedestal.

7. The toy according to claim 1 in which said pedestal has support means fixed to the upper end thereof and laterally spaced from said bearing sleeve and said clapper comprising a spring member supported at one end by said support means and depending therefrom with a striker thereon normally disposed in a limited spaced relationship to said bell, actuating means fixed to the inner portion of said body and rotatable therewith, and camlike means on said actuating means engageable with the opposite depending end of said spring member and operable to snap said spring in a manner to cause said striker to impinge upon said bell as aforesaid.

8. The toy according to claim 7 in which said support means comprises a substantially horizontal member fixed to the upper end of said pedestal and having said bell and upper end of said spring member fixed thereto as aforesaid, said horizontal support member having cam means on the periphery thereof, and a plurality of elongated members extending through said body and movably supported by said body intermediately of the ends of said elongated members, the outer ends of said elongated members extending beyond said body and the inner ends thereof engaging said cam means to effect pivotal movement of said members.

9. The toy according to claim 8 in which said body simulates an apple and said elongated members have heads on the outer ends thereof and simulate worms and worm heads projecting from said body.

10. The toy according to claim 9 in which said cam means of the periphery of said horizontal support member depend from said member and are circular and substantially sinuous, and said elongated members being readily flexible and engagement of the inner ends thereof with said cam means causing said outer ends of said members and the heads thereon to bob up and down as said body is rotated when said toy is pulled along a support surface as aforesaid.

* * * * *